United States Patent [19]

Gerold et al.

[11] Patent Number: 4,842,564

[45] Date of Patent: Jun. 27, 1989

[54] CAP-FIRING MECHANISM FOR A TOY

[75] Inventors: Gregory L. Gerold; Bruce W. Dickerhoof, both of Cincinnati, Ohio

[73] Assignee: Tonka Corporation, Minnetonka, Minn.

[21] Appl. No.: 238,486

[22] Filed: Aug. 31, 1988

[51] Int. Cl.[4] ..... A63H 3/28; A63H 5/00

[52] U.S. Cl. ..... 446/297; 446/398; 446/404

[58] Field of Search ..... 446/297, 298, 24, 23, 446/268, 271, 398, 399, 401, 402, 403, 404, 405, 473, 407, 406; 42/54; 124/2

[56] References Cited

U.S. PATENT DOCUMENTS

| | | | |
|---|---|---|---|
| 730,182 | 6/1903 | Wenzel | 446/401 |
| 1,439,672 | 12/1922 | Keegan | 446/398 X |
| 2,137,159 | 11/1938 | Fischer | 446/398 |
| 2,457,921 | 1/1949 | Riederich | 446/401 X |
| 3,029,557 | 4/1962 | Lemelson | 446/398 X |
| 4,723,931 | 2/1988 | Allen et al. | 446/297 X |

FOREIGN PATENT DOCUMENTS

| | | | |
|---|---|---|---|
| 666110 | 10/1938 | Fed. Rep. of Germany | 446/23 |
| 2013507 | 8/1957 | United Kingdom | 446/402 |
| 2151147 | 7/1985 | United Kingdom | 446/23 |

*Primary Examiner*—Robert A. Hafer
*Assistant Examiner*—D. Neal Muir
*Attorney, Agent, or Firm*—Marshall, O'Toole, Gerstein, Murray & Bicknell

[57] ABSTRACT

A cap firing mechanism for use with a cap strip and in a toy having a wall and a housing, and comprising an anvil mounted on the wall and a firing mechanism mounted in the housing. The mechanism includes a mounting pin connected to the housing, and a hammer mounted on the pin. A hammer spring connected to the hammer urges the hammer against the anvil in order to fire a cap between the hammer and the anvil. An extended portion of the hammer is manually engageable in order to swing the hammer away from the anvil, and the hammer spring returns the hammer against the anvil when the extended portion is released. An advance wheel is mounted on the pin adjacent the hammer, and an advance mechanism connects the hammer with the advance wheel. The advance mechanism turns the wheel in one direction to advance the cap strip between the anvil and the hammer, the movement of the hammer operating to rotate the advance wheel. The wheel holds the strip during the firing of a cap. The mechanism may be used in a toy action figure wherein the wall is within the torso of the figure and the housing is formed by a backpack of the figure.

16 Claims, 2 Drawing Sheets

CAP-FIRING MECHANISM FOR A TOY

FIELD AND BACKGROUND OF THE INVENTION

This invention relates to a toy, and more particularly to a toy including a cap-firing mechanism.

Cap-firing mechanisms have long been known and are commonly in use in toys of various types. Cap-firing mechanisms are commonly found in toy pistols, and U.S. Pat. Nos. 542,212, 1,398,277 and 2,758,585 show examples of toy pistols including cap-firing mechanisms. U.S. Pat. Nos. 372,990 and 764,023 describe figures of animals which include cap-firing mechanisms. U.S. Pat. Nos. 476,895, 2,167,042, 4,182,070 and 4,536 toy figures wherein a cap-firing mechanism is included in an arm or in the torso of the figure. Further, U.S. Pat. Nos. 3,978,611, 3,986,295, 4,003,158, 4,569,666 and 4,583,958 describe toys including mechanisms (other than cap mechanisms) for making noise and/or for firing projectiles of some nature.

It is a general object of the present invention to provide an improved cap-firing mechanism for installation in, for example, a toy figure, which has an improved advance mechanism and has a rapid firing arrangement.

SUMMARY OF THE INVENTION

A cap firing mechanism in accordance with this invention is for use with a cap strip and in a toy having a wall and a housing, and comprises an anvil adapted to be mounted on the wall and a firing mechanism adapted to be mounted in the housing. The mechanism includes a mounting pin adapted to be connected to the housing, and a hammer mounted on the pin. A hammer spring connected to the hammer urges the hammer against the anvil in order to fire a cap between the hammer and the anvil. An extended portion of the hammer is manually engageable in order to swing the hammer away from the anvil, and the hammer spring returns the hammer against the anvil when the extended portion is released. An advance wheel is mounted on the pin adjacent the hammer, and an advance mechanism connects the hammer with the advance wheel. The advance mechanism turns the wheel in one direction to advance the cap strip between the anvil and the hammer, the movement of the hammer operating to rotate the advance wheel. The wheel holds the strip during the firing of a cap.

The mechanism may be used in a toy action figure wherein the wall is within the torso of the figure and the housing is formed by a backpack of the figure.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Figure 1:
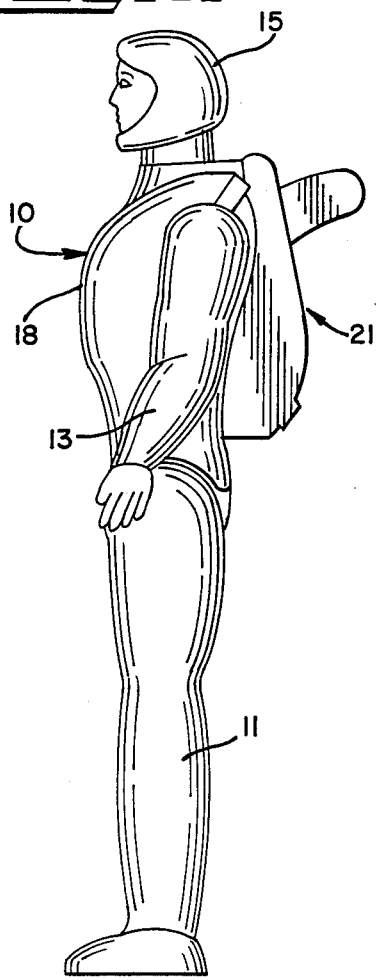
FIG. 1 is a side view of a toy action figure including a cap-firing mechanism in accordance with the present invention.
Figure 2:
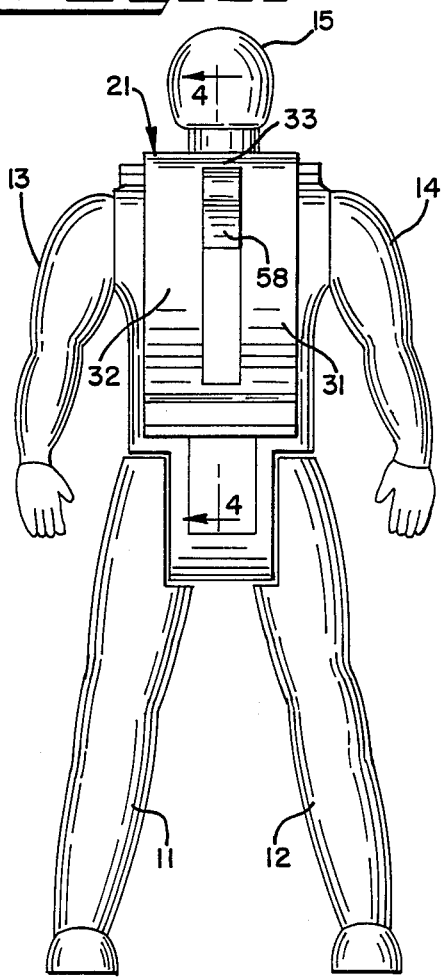
FIG. 2 is a view of the back of the figure shown in FIG. 1.

In the specific example of the invention illustrated in the drawings, the cap-firing mechanism is mounted in a toy figure of a robot having generally the shape of a human figure. The figure includes a torso 10, two legs 11 and 12 extending downwardly from the torso 10, arms 13 and 14 at the sides of the torso 10, and a head 15 at the top side of the torso 10. Each of the parts 11 through 15 is attached to the torso 10 by a conventional pin and socket arrangement shown for the legs in FIG. 5, the pins being on the torso and indicated by the reference numeral 17 in FIGS. 4 and 5.

Figure 5:
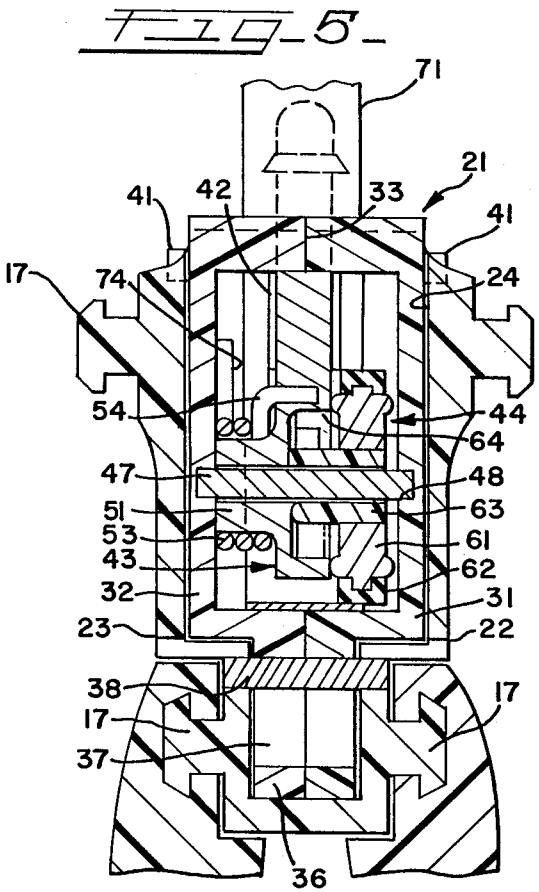
FIG. 5 is an enlarged fragmentary sectional view taken on the line 5—5 of FIG. 4.
Figure 4:
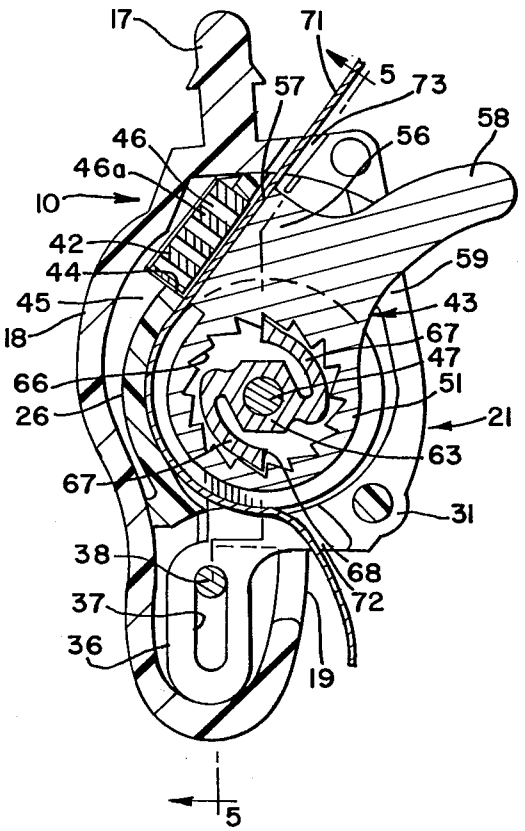
FIG. 4 is an enlarged fragmentary sectional view taken on the line 4—4 of FIG. 2.

With specific reference to FIGS. 4 and 5, the torso, which in this example is made of molded plastic, includes a front wall 18, a rear wall 19, and right and left side walls 22 and 23. The rear wall 19 has an opening 24 formed in it, and the backpack 21 extends through the opening and into the interior of the torso. Extending laterally between the side walls 22 and 23 and adjacent the front wall is an arcuate interior wall 26 (FIG. 4) of the torso. The walls of the torso may be integrally molded.

Figure 3:
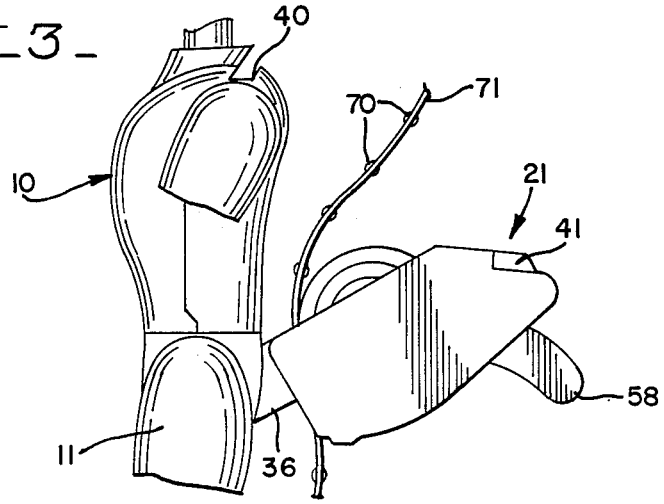
FIG. 3 is a fragmentary side view of the figure, showing the cap-firing mechanism in an open position.

The backpack 21 forms a housing for the cap-firing mechanism and is formed by two housing halves 31 and 32 which are secured together along a vertical (as seen in FIG. 5) center line 33. At its lower end, the two halves 31 and 32 form an elliptical extension 36 (FIG. 4) which has a vertically extending slot 37 formed in it. A horizontally extending hip pin 38 has its ends mounted on the two side walls 22 and 23 of the torso, and the extension 36 is pivotably mounted on the pin 38. As best shown in FIG. 4, the pin 38 extends through the slot 37, and this arrangement enables the backpack to be pivoted between a closed position shown in FIGS. 1, 2, 4 and 5 and an open position shown in FIG. 3. The backpack 21 is held in the closed position by tabs 41 formed on the two halves adjacent their upper corners, the tabs being movable into slots or detents 40 (FIG. 3) formed in the upper parts of the side walls of the torso. To move the backpack from the closed to the open position, the backpack is first moved upwardly a short distance relative to the torso in order to move the tabs 41 upwardly out of the slots 40. The vertically elongated opening 37, of course, allows for such movement. The backpack is then swung upwardly and clockwise as seen in FIGS. 3 and 4 to move it to the open position shown in FIG. 3. To close the backpack, it is swung in the counterclockwise direction and then moved downwardly to move the tabs 41 into the slots. There is preferably a tight fit of the tabs 41 in the slots 40 so that the backpack snap locks into the closed position.

A cap-firing mechanism is mounted in the backpack 21 and on the interior wall 26. With continued reference to FIGS. 4 and 5, the firing mechanism includes an anvil 42 mounted on the interior wall 26 of the torso, and a hammer 43 and an advance device 44 mounted in the backpack 21.

The anvil 42 comprises a generally square piece of sheet metal which is secured in an opening 44 formed in the interior wall. The anvil 42 has a plurality of holes or slots 46 formed through it, and the left or front side of the anvil is closely adjacent the front wall 18 of the torso. The front or left (as seen in FIG. 4) side of the wall 26 and the anvil 42 are spaced from the front wall 18 of the torso, thereby forming a muffler space 45 between them. The edges of the interior wall 26 are connected to the torso walls. The holes 46 in the anvil provide important advantages which are described hereinafter.

With reference to the parts mounted in the backpack 21, the hammer 43 and the advance device 44 are mounted on a laterally extending mounting or hammer pin 47. The end portions of the pin 47 extend into holes 48 formed in the sides of the backpack.

The hammer 43 includes a hub 51 (FIG. 5) having a center passage which receives the pin 47. A torsion hammer spring 53 is wound around the hub 51 and has one end connected to the adjacent side of the backpack half 32 and its other end 54 connected to the hammer 43. The torsion spring 53 is wound to urge the hammer 43 in the counterclockwise direction as seen in FIG. 4 around the pin 47. The upper side of the hammer 43 extends upwardly from the hub 51 and includes a hammer portion 56 having a flat face 57. As shown in FIG. 4, the face 57 is shaped so that it lies flat against the flat adjacent side of the anvil 42 when the hammer is swung to its maximum counterclockwise position. To the rear of the hammer portion 56 is formed a manually engageable extended trigger portion 58 of the hammer, and the trigger portion angles upwardly and rearwardly from the hub. A vertically elongated slot 59 is formed in the back side of the backpack 21, and the portion 58 extends through the slot 59 and out of the backpack, as shown in FIGS. 1, 3 and 4.

The advance device 44 includes a circular advance wheel 61 and an annular friction belt 62 fastened to the outer surface of the wheel 61. The inner periphery of the wheel 61 is fastened to the hub 63 of a clutch which also extends into a circular central opening 64 formed in the hammer 43. With reference to FIG. 4, ratchet or saw teeth 66 are formed around the inner periphery of the opening 64, and the hub 63 has ratchet arms 67 which extend outwardly and engage the teeth 66. The arms 67 angle outwardly and in the counterclockwise direction and have flat ends 68 which engage flat faces of the teeth 66. The arms 67 are somewhat flexible so that the ends of the arms are able to slide over the tips of the saw teeth 66 as the hub 63 of the clutch is rotated clockwise (as seen in FIG. 4) relative to the hammer 43. However, clockwise movement (as seen in FIG. 4) of the hammer 43 causes the teeth to engage the arms 67 and rotate the hub 63 and the advance wheel with the hammer.

The cap firing mechanism is used with a cap strip or tape 71 of the type including a long strip of paper having explosive caps 70 (FIG. 3) at spaced intervals along its length. To load the cap strip 71, the backpack 21 is swung to the open position shown in FIG. 3, and the strip 71 is threaded upwardly through an opening 72 formed in the bottom of the backpack 21, to the left of the hammer 43 and the advance wheel 44, and out of an opening 73 between the upper end of the backpack and the torso. As shown in FIG. 5, the center line of the strip (where the caps are located) is positioned between the face 57 of the hammer and the anvil, and the belt 62 overlies an edge portion of the strip. When the backpack is moved to the closed position, the belt 62 engages the strip 71 and the strip is pinched tightly between the belt 62 and the arcuate interior wall 26, as shown in FIG. 4. Raised portions 74 (FIG. 5) are formed at the sides of the interior wall 26 and they are spaced a distance apart which is substantially equal to the lateral width of the tape, and the portions 74 form a channel between them which hold the tape in place in front of the hammer and the advance wheel.

Assuming that a strip of tape has been loaded in the mechanism, an operator presses downwardly on the hammer portion 58, thereby causing the hammer to swing in the clockwise direction as seen in FIG. 4 away from the anvil and the cap strip. The teeth 66 of the hammer engage and rotate the arms 67, and the advance wheel also rotates clockwise. The friction belt 62 tightly engages the strip 71 and moves it upwardly for a distance which is substantially equal to the spacing between the caps on the tape. The operator then releases the portion 58 and the torsion spring 53 returns the hammer toward the anvil, but the tape and the advance wheel remain stationary because of the pressure of the belt 62 against the tape 71 and the wall 26. The portion 56 of the hammer strikes sharply against a cap 70 located between the hammer and the anvil and fires the cap. In addition to the noise, smoke from the cap flows upwardly through the openings between the backpack and the torso, thereby increasing the play value of the toy.

As previously mentioned, the anvil 42 has a number of openings or holes 46 formed in it, the holes 46 being located between a plurality of spaced bars **46*a*. A cap 70 of the tape 71, when in the firing position behind the anvil 42, partially overlies one of the bars 46*a*; when the hammer strikes the portion of the cap on the bar, the portion of the cap fires or explodes and then the remainder of the cap burns. As a result, the amount of noise resulting from the firing of a portion only of a cap is less than is the case where an entire cap is fired. Further, some of the noise from the firing passes through the holes 46 and enters the space 45** which forms a muffler chamber, thereby further reducing the noise level.

Federal regulations govern the amount of noise which may be generated by a cap mechanism. The noise level is reduced by the provision of the holes 46 and muffler space 45 and by the firing of a portion only of a cap, and the bars **46*a* and the holes 46 may be sized to achieve a permissible noise level. The amount of sound may be reduced by making the holes 46 larger and the bars 46*a*** smaller, for example.

Further, if the front wall 18 of the torso is made of a transparent or semitransparent plastic, the firing flash and the burning may be seen through the front wall 18 and the holes 46, thereby increasing the play value.

The firing mechanism has the advantages that the tape is reliably advanced just before each firing and the tape is held firmly in place by the belt 62 during the firing action. A very rapid firing action is possible because the operator simply has to press the hammer portion down and then release it, and this action can be repeated very rapidly. A single part forms the hammer and the manually actuated part, thereby providing a structurally simplified mechanism. Loading a tape or removing scraps of paper is also simplified because the backpack may easily be swung to the open position where all of the parts are accessible.

What is claimed is:

1. A cap firing mechanism for use with a cap tape having a series of spaced caps thereon, comprising:

(a) a plurality of adjacent walls;

(b) an anvil mounted on one of said walls;

(c) mounting means connected to other of said walls adjacent said anvil;

(d) a hammer movably mounted on said mounting means, said hammer including a hammer surface located to engage said anvil;

(e) a hammer spring connected to said hammer and urging said hammer in the direction where said hammer surface strikes said anvil;

(f) an advance wheel on said mounting means and adapted to engage the tape and to move the tape when said wheel is rotated; and (g) advance means connected between said hammer and said wheel for turning said wheel when said hammer is moved away from said anvil.

2. A mechanism as set forth in claim 1, wherein said advance means includes a one-way ratchet.

3. A mechanism as set forth in claim 1, wherein said hammer includes a portion which is adapted to be manually engaged to move said hammer away from said anvil and against the force of said torsion spring.

4. A mechanism as set forth in claim 1, wherein said anvil has at least one opening formed therein.

5. A mechanism as set forth in claim 5, wherein said anvil comprises a plurality of spaced bars which form said opening therebetween, and the widths of said bars are less than the width of said caps, whereby only a portion of a cap is fired.

6. A mechanism as set forth in claim 1, wherein said mounting means comprises a pin, said hammer, said advance wheel and said advance means being rotatably mounted on said pin.

7. A mechanism as set forth in claim 1, wherein said other of said walls are pivotable relative to said one of said walls.

8. A toy action figure and a capfiring mechanism for use with a cap tape having spaced caps thereon, comprising:

(a) a torso including at least one wall;

(b) a backpack formed by backpack walls;

(c) an anvil mounted on said one wall;

(d) mounting means connected to said backpack walls adjacent said anvil;

(e) a hammer movably mounted on said mounting means, said hammer including a hammer surface located to engage said anvil;

(f) a hammer spring connected to said hammer and urging said hammer in the direction where said hammer surface strikes said anvil;

(g) an advance wheel on said mounting means and adapted to engage the tape and to move the tape when said wheel is rotated; and (h) advance means connected between said hammer and said wheel for turning said wheel when said hammer is moved away from said anvil.

9. A toy action figure as set forth in claim 8, and further including pivot means for pivotally connecting said backpack walls to said one wall of said torso.

10. A toy action figure as set forth in claim 8, wherein said torso further includes a front wall which is at least partially transparent, and said anvil has at least one opening formed therein.

11. A toy action figure as set forth in claim 8, wherein said advance means includes a one-way ratchet.

12. A toy action figure as set forth in claim 8, wherein said hammer includes a portion which is adapted to be manually engaged to move said hammer away from said anvil and against the force of said torsion spring, said backpack walls having an opening therein and said portion extending through said opening.

13. A toy action figure as set forth in claim 8, wherein said mounting means comprises a pin, said hammer, said advance wheel and said advance means being rotatably mounted on said pin.

14. A toy action figure as set forth in claim 8, wherein said torso further includes front, back and side walls and said one wall is provided interiorly of said torso and spaced from said front and back walls, a space between said front wall and said one wall forming a muffler space, said anvil comprising a plurality of spaced bars which form openings therebetween, and said openings communicating with said muffler space.

15. A toy action figure as set forth in claim 14, wherein said bars have widths which are less than the width of said caps on said tape.

16. A toy action figure as set forth in claim- 14, wherein said front wall is at least partially transparent.

* * * * *